US010213041B1

(12) United States Patent
Fonseca

(10) Patent No.: US 10,213,041 B1
(45) Date of Patent: Feb. 26, 2019

(54) MODULAR HOLIDAY TREE DEVICE

(71) Applicant: Brian Fonseca, Central Falls, RI (US)

(72) Inventor: Brian Fonseca, Central Falls, RI (US)

( * ) Notice: Subject to any disclaimer, the term of this patent is extended or adjusted under 35 U.S.C. 154(b) by 97 days.

(21) Appl. No.: 15/263,718

(22) Filed: Sep. 13, 2016

(51) Int. Cl.

| | |
|---|---|
| ***A47G 33/06*** | (2006.01) |
| ***A47B 47/00*** | (2006.01) |
| ***F21S 6/00*** | (2006.01) |
| ***A47B 61/00*** | (2006.01) |
| ***A47B 85/06*** | (2006.01) |
| ***F21V 21/112*** | (2006.01) |
| ***F21V 23/00*** | (2015.01) |

(52) U.S. Cl.
CPC ..... *A47G 33/06* (2013.01); *A47B 47/0091* (2013.01); *A47B 61/003* (2013.01); *A47B 85/06* (2013.01); *F21S 6/004* (2013.01); *F21V 21/112* (2013.01); *F21V 23/002* (2013.01)

(58) Field of Classification Search
CPC .... A47G 33/06; A47B 47/0091; A47B 85/06; A47B 61/003; F21S 6/004; F21V 23/002; F21V 21/12
USPC ..... 248/125.8, 158
See application file for complete search history.

(56) References Cited

U.S. PATENT DOCUMENTS 1,490,409 A * 4/1924 Ventresca ..... A47G 33/06 428/18
1,577,207 A * 3/1926 Dieperink-Langereis ..... A47G 33/06 108/94
2,447,924 A * 8/1948 Vitale ..... A47G 25/0664 211/205
2,683,210 A 7/1954 Baenziger
3,119,588 A * 1/1964 Keats ..... E01F 13/02 116/173
3,674,612 A 7/1972 Gehl, Jr.
4,678,089 A * 7/1987 Lang ..... A47F 5/06 211/133.4
4,734,301 A * 3/1988 McKinney ..... A41G 1/007 211/196
5,085,901 A * 2/1992 Johnson ..... A47G 33/06 211/196
5,735,415 A 4/1998 Wilson
5,776,559 A * 7/1998 Woolford ..... F21S 4/10 362/123
D414,056 S 9/1999 Palm
6,273,584 B1 * 8/2001 Wang ..... A47G 33/06 362/123
6,425,646 B1 7/2002 Andrews
6,652,927 B1 * 11/2003 Chen ..... A47G 33/06 362/123
6,688,239 B1 2/2004 Pettini
6,818,264 B1 * 11/2004 Samperisi, Jr. ..... A47G 33/12 428/18
7,144,610 B1 12/2006 Estes
(Continued)

FOREIGN PATENT DOCUMENTS

WO 9719625 A1 6/1997

*Primary Examiner* — Stanton L Krycinski
(74) *Attorney, Agent, or Firm* — Kyle A. Fletcher, Esq.

(57) ABSTRACT

The modular holiday tree device is a convertible item of furniture for domestic use. The modular holiday tree device is multi-functional. The function of the modular holiday tree device converts between a floor lamp, an apparel rack, a display rack, and a holiday tree. The modular holiday tree device comprises a base, a stanchion, and an electric fixture.

14 Claims, 8 Drawing Sheets

(56) References Cited

U.S. PATENT DOCUMENTS

| | | | | |
|---|---|---|---|---|
| 7,163,725 | B2 * | 1/2007 | Johnson | A41G 1/007 362/101 |
| 7,445,824 | B2 * | 11/2008 | Leung | A41G 1/007 156/61 |
| 7,585,552 | B2 * | 9/2009 | Meseke | G09F 19/08 108/50.12 |
| D601,365 | S * | 10/2009 | LaValley | D6/677.1 |
| 9,011,996 | B1 * | 4/2015 | Adolfson | A47G 33/06 428/18 |
| 9,664,362 | B2 * | 5/2017 | Chen | A47G 33/06 |
| 9,671,074 | B2 * | 6/2017 | Chen | A47G 33/06 |
| 9,677,748 | B1 * | 6/2017 | Chen | F21V 23/003 |
| 9,677,749 | B2 * | 6/2017 | Chen | F21V 23/009 |
| 9,782,020 | B2 * | 10/2017 | Bacon | A47B 57/18 |
| 9,833,098 | B2 * | 12/2017 | Loomis | A47G 33/06 |
| 9,883,566 | B1 * | 1/2018 | Chen | H05B 37/0272 |
| 9,883,706 | B2 * | 2/2018 | Chen | A47G 33/06 |
| 9,894,949 | B1 * | 2/2018 | Chen | A41G 1/005 |
| 2003/0106472 | A1 | 6/2003 | Lonneman | |
| 2005/0048226 | A1 * | 3/2005 | Gary | A47G 33/06 428/18 |
| 2006/0245177 | A1 * | 11/2006 | Tsai | A47G 33/06 362/123 |
| 2014/0339185 | A1 * | 11/2014 | Ellison | A47F 5/04 211/119.003 |
| 2016/0088968 | A1 * | 3/2016 | Achterhuis | A47G 33/06 362/249.16 |
| 2017/0208969 | A1 * | 7/2017 | Gayles | A47G 33/06 |

* cited by examiner

MODULAR HOLIDAY TREE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including furniture, more specifically, a convertible furniture combination comprising a lamp, coat rack, a table, and an artificial holiday tree.

SUMMARY OF INVENTION

The modular holiday tree device is a convertible item of furniture for domestic use. The modular holiday tree device is multi-functional. The function of the modular holiday tree device converts between a floor lamp, an apparel rack, a display rack, and a holiday tree.

These together with additional objects, features and advantages of the modular holiday tree device will be readily apparent to those of ordinary skill in the art upon reading the following detailed description of the presently preferred, but nonetheless illustrative, embodiments when taken in conjunction with the accompanying drawings.

In this respect, before explaining the current embodiments of the modular holiday tree device in detail, it is to be understood that the modular holiday tree device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the modular holiday tree device.

It is therefore important that the claims be regarded as including such equivalent construction insofar as they do not depart from the spirit and scope of the modular holiday tree device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
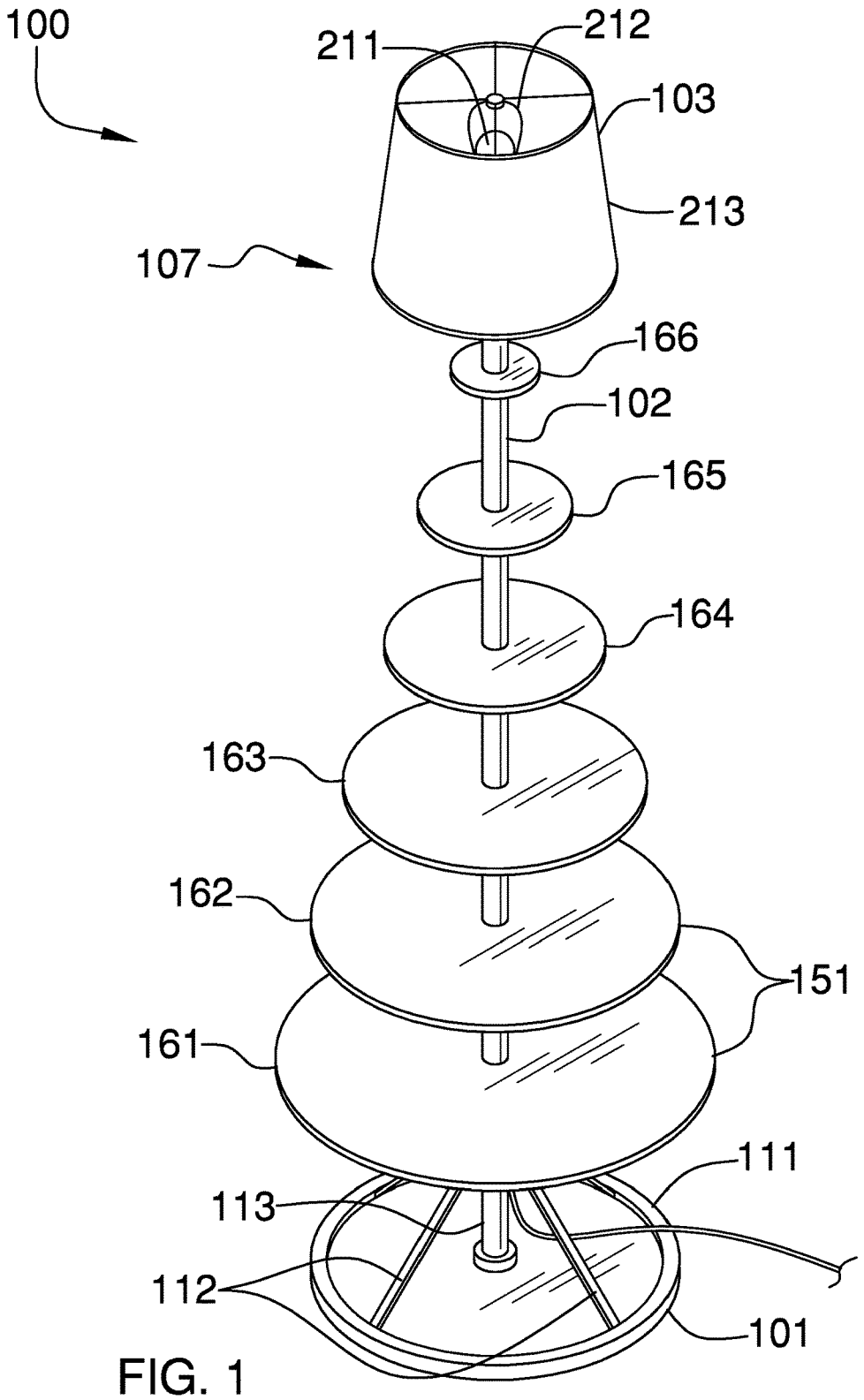
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 10.

The modular holiday tree device 100 (hereinafter invention) comprises a base 101, a stanchion 102, and an electric fixture 103. The invention 100 is a convertible item of furniture for domestic use. The invention 100 is multi-functional. The function of the invention 100 converts between a lamp 105, an apparel rack 106, a display rack 107, and a holiday tree 108.

The stanchion 102 comprises a plurality of pipes 121. Each of the plurality of pipes 121 further comprises a tube 122 and a ferrule 123. With the exception of the span of the length of the center axis of a pipe, each pipe contained in the plurality of pipes 121 is otherwise identical to the pipes remaining in the plurality of pipes 121. Each of the plurality of pipes 121 is further defined with a first end 221 and a second end 222. The ferrule 123 is attached to the first end 221 of the tube 122. As shown most clearly in FIGS. 5 and 6, the stanchion 102 is formed by interconnecting each of the plurality of pipes 121 in a tent pole configuration by inserting the ferrule 123 of a second pipe 202 selected from the plurality of pipes 121 into the second end 222 of a first pipe 201 selected from the plurality of pipes 121. This process is repeated until for all the pipes contained within the plurality of pipes 121. When the process is completed, one end of the stanchion 102 will have a ferrule 123 available for connecting to the base 101.

Figure 6:
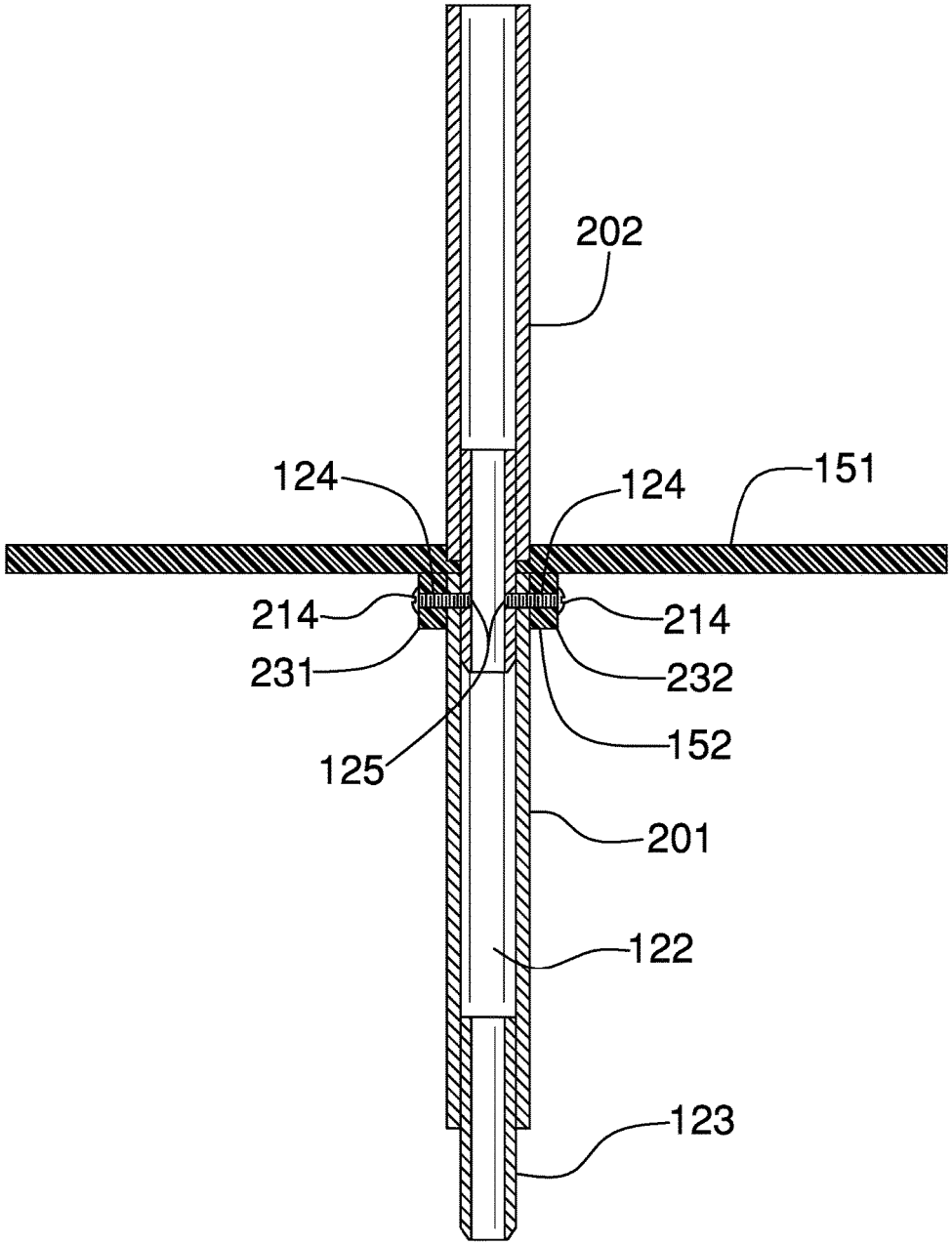
FIG. 6 is a cross-sectional view of an embodiment of the disclosure across 6-6 as shown in FIG. 4.

As shown most clearly in FIG. 6, the second end 222 of each pipe selected in the plurality of pipes 121 has formed in it a first radial hole 124. The ferrule 123 of each pipe selected in the plurality of pipes 121 has formed in it a second radial hole 125. The first radial hole 124 and the second radial hole 125 are located such that when the ferrule 123 of a second selected pipe 202 is inserted into the second end 222 of a first selected pipe 201 the first radial hole 124 of the first selected pipe 201 and the second radial hole 125 of the second selected pipe 202 will align in such a manner that the relative position of the first selected pipe 201 to the second selected pipe 202 can be locked into place using commercially available hardware 214.

The stanchion 102 further comprises a plurality of collar sets 126. The plurality of collar sets 126 further comprises a collection of individual collar sets. Each individual collar set contained within the plurality of collar sets 126 is customized to support a function to which the invention 100 can be converted. The role and use of each individual collar set contained within the plurality of collar sets 126 is discussed elsewhere in this disclosure. Any collar selected from any collar set contained within the plurality of collar sets 126 further comprises a first arm 231 and a second arm 232. As shown in FIG. 6, the first arm 231 is formed with a first hole that allows the first arm 231 to be attached to the first radial hole 124 when it is aligned with the second radial hole 125 using commercially available hardware 214. The second arm 232 is formed with a second hole that allows the second arm 232 to be attached to the first radial hole 124 when it is aligned with the second radial hole 125 using commercially available hardware 214. The attachment is the first arm 231 of a selected collar and the second arm 232 of the selected collar to the stanchion 102 attaches the selected collar to the stanchion 102.

The base 101 is a structure that is placed on a supporting surface 215 such that the stanchion 102 is held vertically. The base 101 comprises a floor disk 111, a plurality of struts 112, and a center post 113. The floor disk 111 is a disk shaped structure that rests on the supporting surface 215. The purpose of the floor disk 111 is to prevent the invention 100 from tipping when the stanchion 102 is subjected to a force in the horizontal direction. As shown most clearly in FIGS. 1 through 3, the floor disk 111 attaches to a center post 113 using a plurality of struts 112. The center post 113 is a cylindrical pipe. The center post 113 is positioned relative to the floor disk 111 such that the center axis of the center post 113 passes through the center of the floor disk 111. The span of the inner diameter of the center post 113 is the same of the span of the inner diameter of the second end 222 of any pipe selected from the plurality of pipes 121 such that the ferrule 123 can be inserted into the center post 113 to attach the stanchion 102 to the base 101. A third radial hole 114 is formed in the end of the center post 113 that is distal from the supporting surface 215. The third radial hole 114 attaches the center post 113 to the stanchion 102 in a manner similar to how the first radial hole 124 and the second radial hole 125 connect a first selected pipe 201 to a second selected pipe 202 within the stanchion 102. Methods to attach center posts 113 to a floor disk 111 using a plurality of struts 112 are well known and documented in the mechanical arts.

The electric fixture 103 is a light fixture that is attached to the end of the stanchion 102 that is distal from the base 101. The electric fixture 103 comprises a socket 131, a lamp collar 132, a cable 133, and a plug 134. The socket 131 is a readily and commercially available port that provides an electrical power connection using an interior screw thread of a threaded connection. The socket 131 is nominally designed to receive a light bulb 211 that is fitted with a matching exterior screw thread connection. Commercially available adapters are available that that allow other devices to receive electrical power through the socket 131. In the first potential embodiment of the disclosure, the socket 131 further comprises a switch. The socket 131 is attached to the lamp collar 132. The lamp collar 132 attaches the socket 131 to the end of the stanchion 102 that is distal from the base 101. As shown most clearly in FIG. 4, the lamp collar 132 is further formed with a collar ferrule 135 that is used to attach the lamp collar 132 to the stanchion 102. The collar ferrule 135 further comprises a fourth radial hole 137. The fourth radial hole 137 attaches the lamp collar 132 to the stanchion 102 in a manner similar to how the first radial hole 124 and the second radial hole 125 connect a first selected pipe 201 to a second selected pipe 202 within the stanchion 102. The cable 133 transports electricity from the national electric grid to the socket 131. The cable 133 is threaded through the center post 113, the stanchion 102, and the lamp collar 132. The cable 133 is terminated with a plug 134. The plug 134 is a commercially available NEMA 1-15P electrical plug that connects the cable 133 to the national electric grid. Methods to wire the electric circuit described in this paragraph are well known and documented in the electrical arts.

The lamp 105 configuration of the invention 100 is a freestanding lighting device intended to provide illumination. When the invention 100 is used in the lamp 105 configuration a light bulb 211 is screwed into the socket 131 and a harp 212 is attached to the lamp collar 132 such that a shade 213 can be placed over the light bulb 211.

The invention 100 further comprises a plurality of conversion plugs 136. Each of the plurality of conversion plugs 136 is customized to support a function to which the invention 100 can be converted. Each conversion plug selected from the plurality of conversion plugs 136 further comprises an exterior screw thread that allows the selected conversion plug to be screwed into the socket 131.

The plurality of collar sets 126 further comprises one or more hook collars 142 and a plurality of shelf collars 152. The use of each of the plurality of collar sets 126 is described elsewhere in this disclosure.

The plurality of conversion plugs 136 further comprises a hook plug 141 and a tree plug 181. The use of each of the plurality of conversion plugs 136 is described elsewhere in this disclosure.

Figure 2:
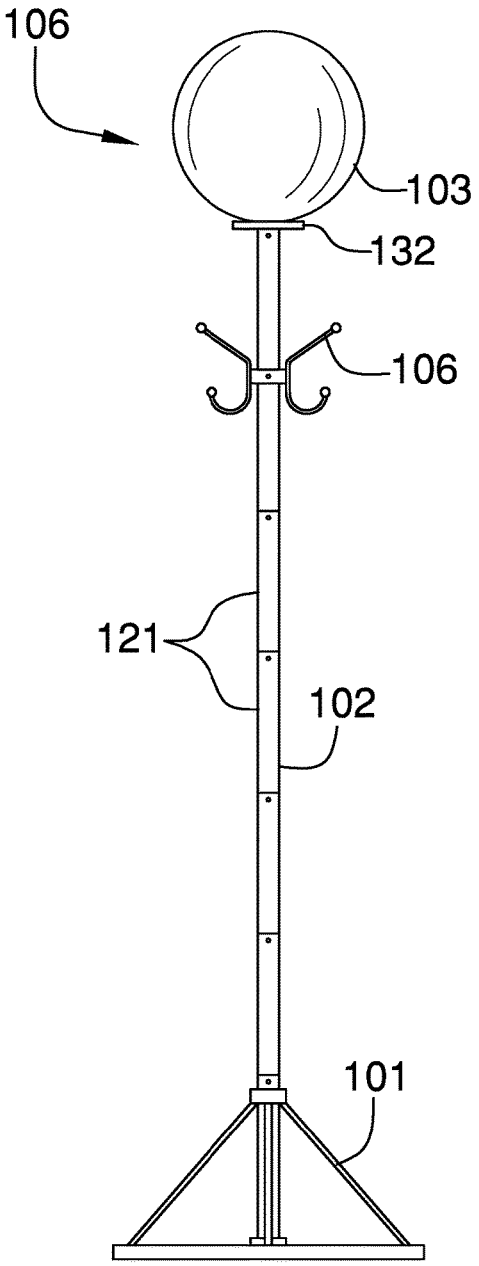
FIG. 2 is a side view of an embodiment of the disclosure.
Figure 3:
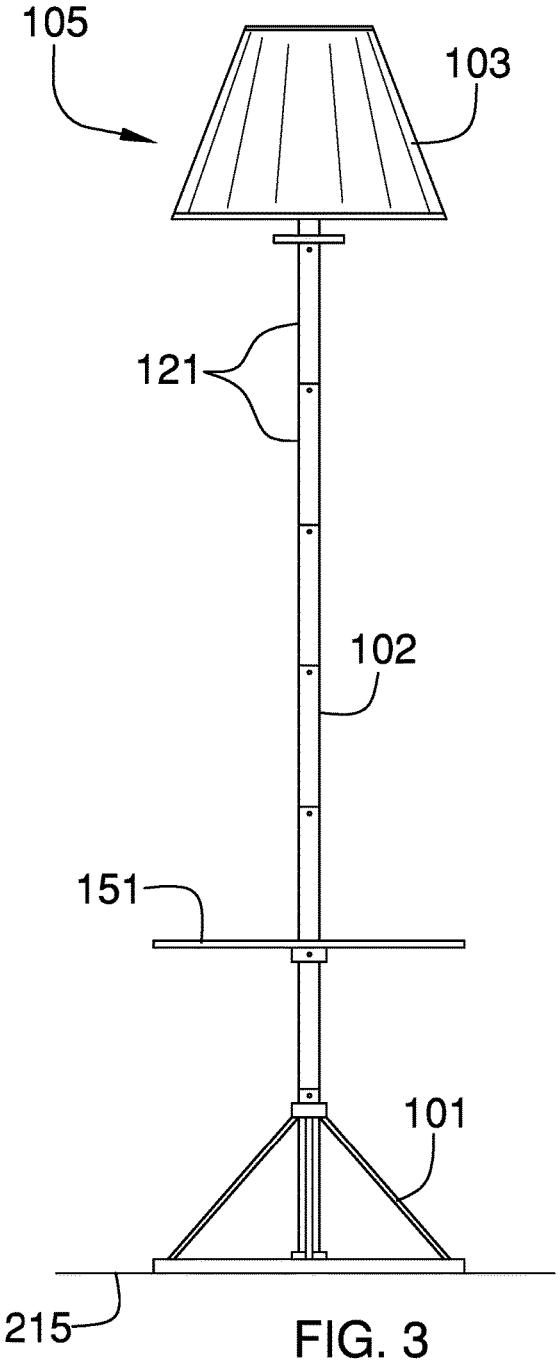
FIG. 3 is a side view of an alternate embodiment of the disclosure.
Figure 9:
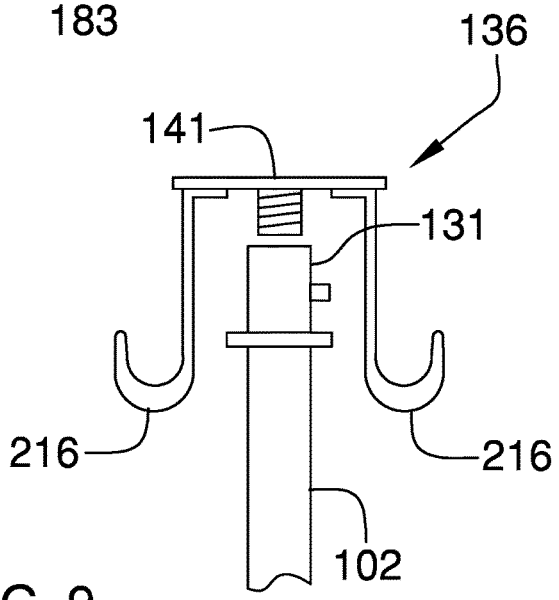
FIG. 9 is a detail view of an embodiment of the disclosure.
Figure 10:
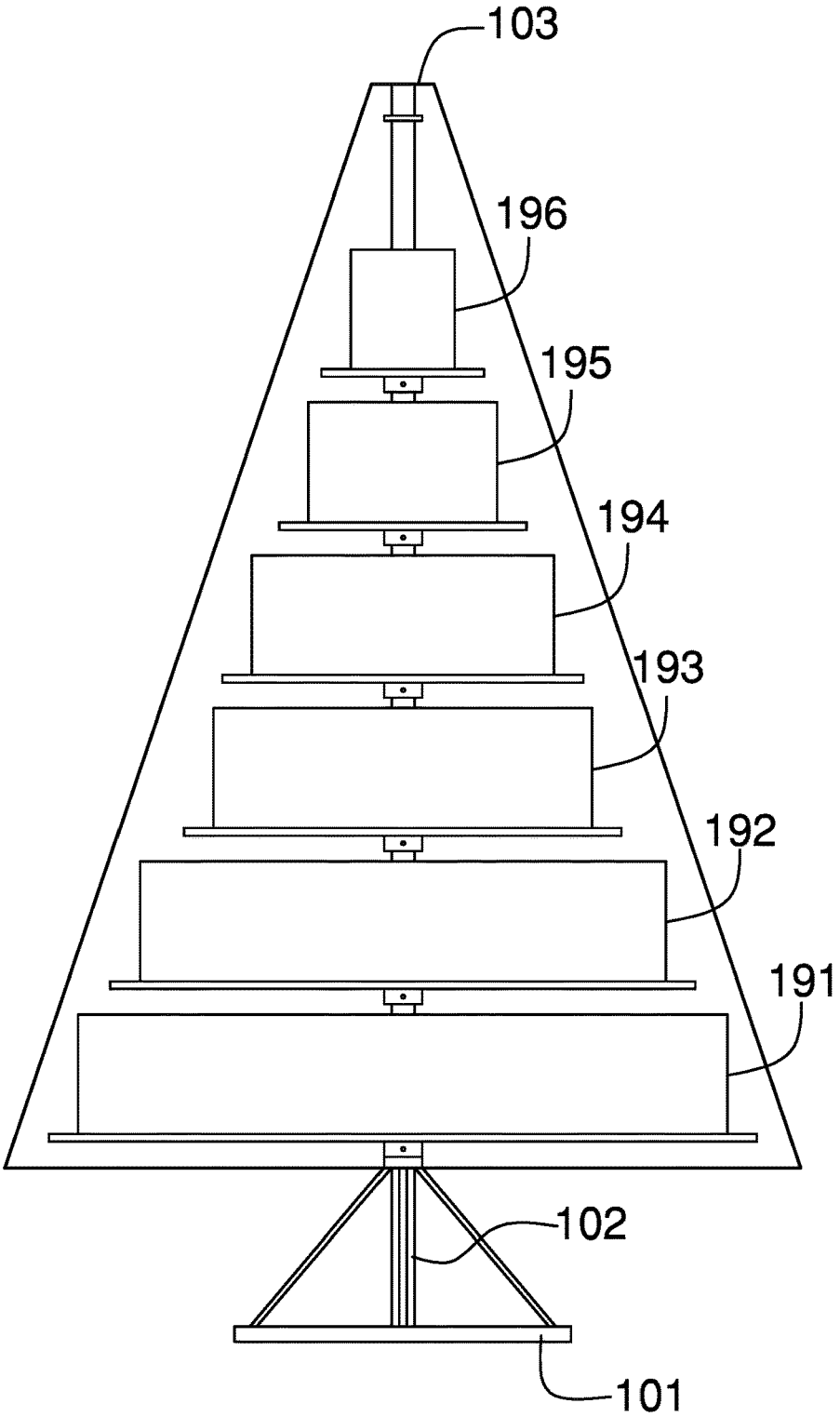
FIG. 10 is a detail view of an embodiment of the disclosure.

The apparel rack 106 configuration of the invention 100 is adapted to receive apparel for storage. As shown most clearly in FIG. 2, when the invention 100 is used in an apparel rack 106 configuration the plurality of collars further comprises the use of one or more hook collars 142. As shown most clearly in FIG. 2, each of one or more hook collars 142 is a collar, as described elsewhere in this disclosure, which further comprises a plurality of apparel hooks 216 that are intended to receive apparel. Each of the one or more hook collar 142 attaches to the stanchion 102 as described elsewhere in this disclosure. As shown in FIG. 2, the apparel rack 106 configuration can be used in conjunction with the lamp 105 configuration. Alternatively, the hook plug 141 can be used. As shown in FIG. 9, the hook plug 141 is an apparatus that is designed to screw into the socket 131. The hook plug 141 further comprises a plurality of apparel hooks 216 such that the hook plug 141 can also receive apparel.

The display rack 107 configuration provides shelf space upon which domestic articles, such as pictures, may be stored and displayed upon the invention 100. The display rack 107 configuration further comprises a plurality of shelf disks 151 and the plurality of shelf collars 152. Each of the plurality of shelf disks 151 is a plate that is formed in the shape of a circular disk. Any shelf disk selected from the plurality of shelf disks 151 can be differentiated from every shelf disk remaining in the plurality of shelf disks 151 by differences in the span of the diameter of each of the plurality of shelf disks 151. Each shelf disk selected from the plurality of shelf disks 151 further comprises a post hole 153. The post hole 153 is a cylindrical aperture formed through the selected shelf disk such that the center axis of the post hole 153 aligns with both the center and the center axis of the selected shelf disk. The span of the diameter of the post hole 153 is greater than the span of the outer diameter of each of the plurality of pipes 121 such that each of the plurality of pipes 121 can be inserted through the post hole 153. The diameter of the post hole 153 of each of the plurality of shelf disks 151 is congruent. As shown most clearly in FIGS. 2 and 4, each of the plurality of shelf collars 152 is a disk shaped collar that attaches to the stanchion 102 as described elsewhere in this disclosure. The diameter of each of the plurality of shelf collars 152 is greater than the diameter of the post holes 153. Each shelf disk selected from the plurality of shelf disks 151 is supported by a shelf collar selected from the plurality of shelf collars 152.

Figure 4:
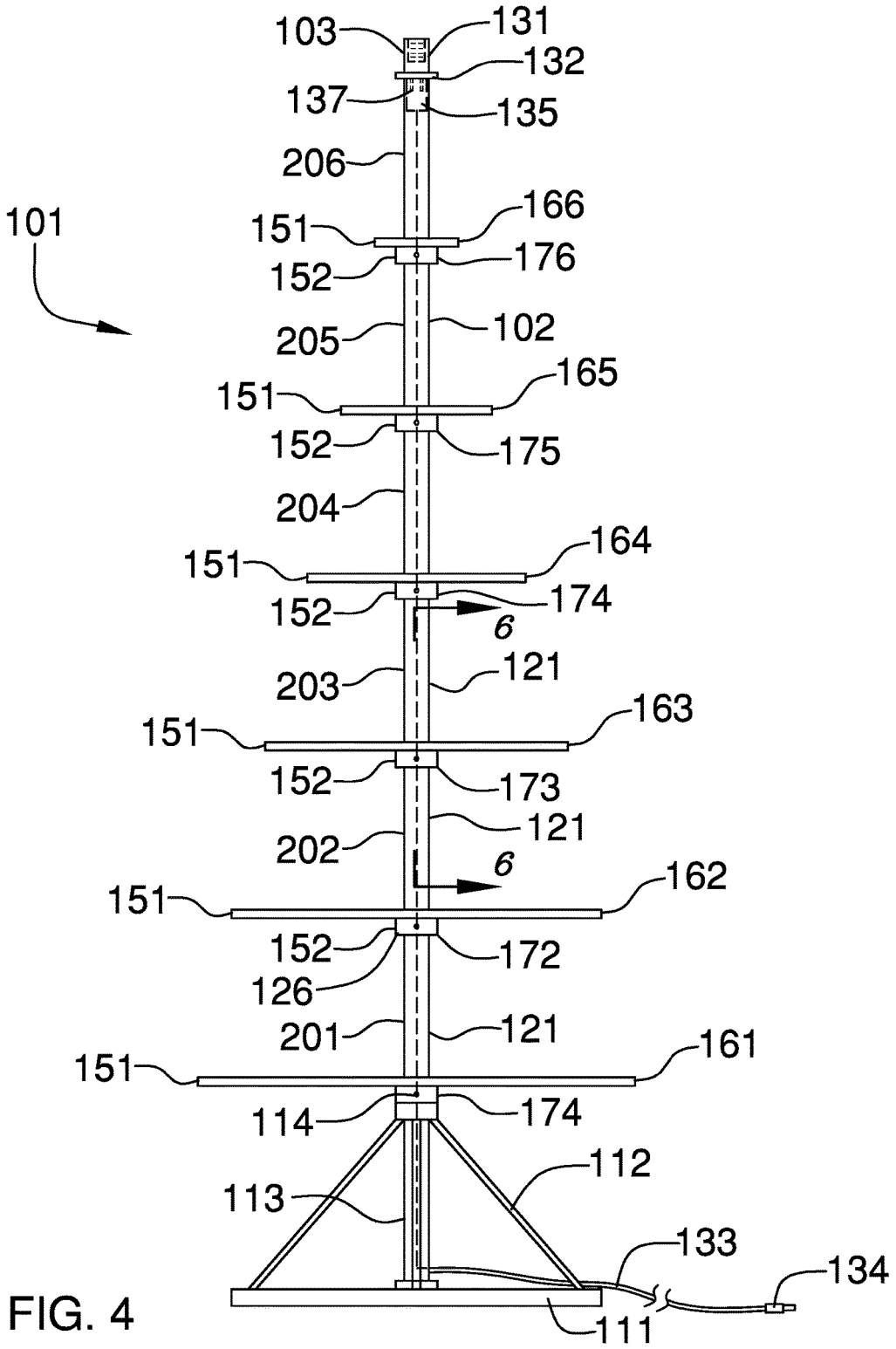
FIG. 4 is a side view of an alternate embodiment of the disclosure.
Figure 5:
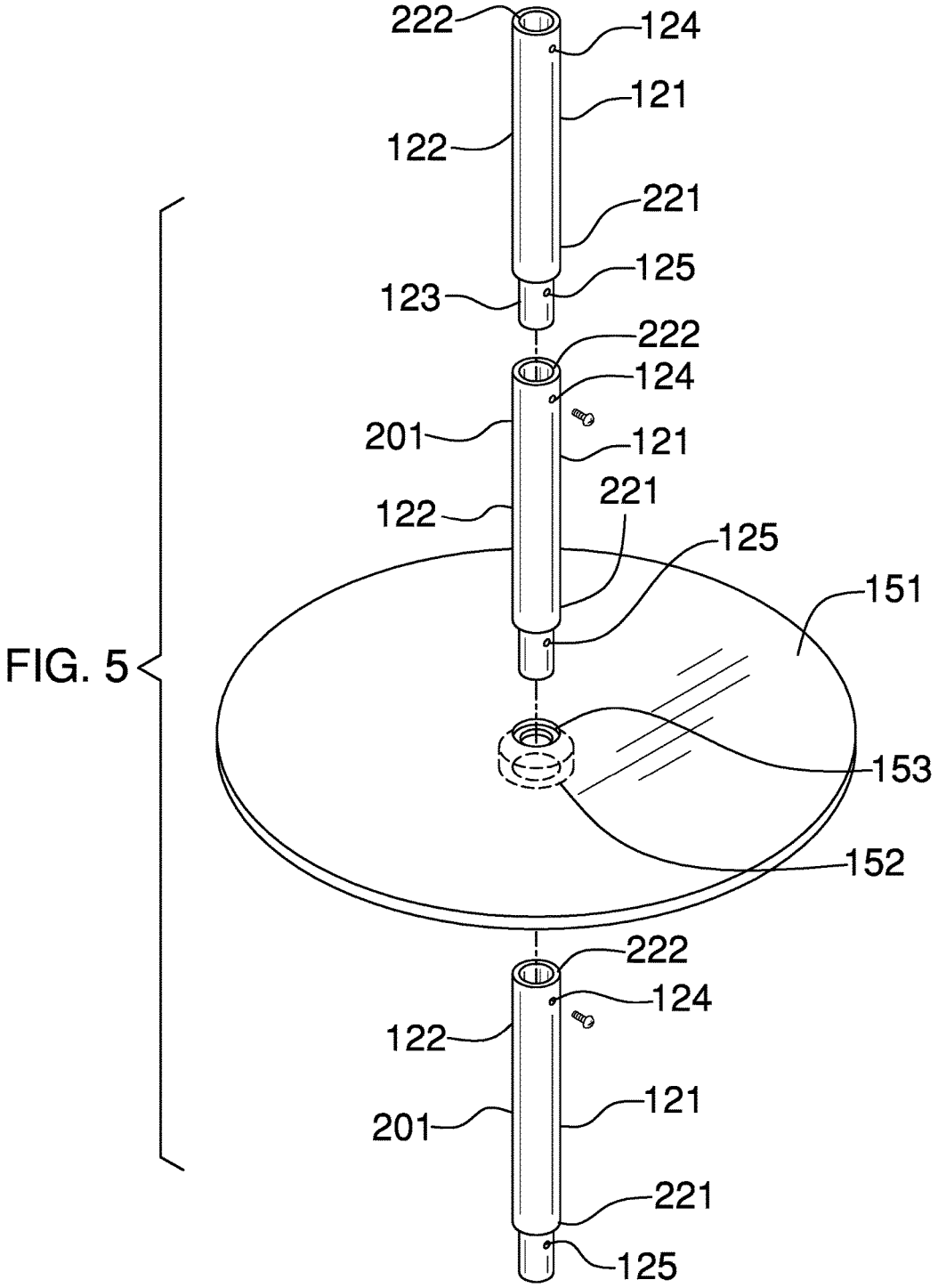
FIG. 5 is an exploded view of an embodiment of the disclosure.

As shown most clearly in FIG. 4, the plurality of shelf disks 151 are attached to the stanchion 102 such that the plurality of shelf disks 151 from a conical plate structure that further comprises a space between each of the plurality of shelf disks 151. As most clearly in FIG. 1, the display rack 107 configuration can be used in conjunction with the lamp 105 configuration.

To provide a detailed example of how the invention 100 is assembled, this paragraph and the next paragraph describes the assembly of the display rack 107 configuration of the first potential embodiment of the disclosure. In the first potential embodiment of the disclosure, the plurality of shelf disks 151 comprises a first shelf disk 161, a second shelf disk 162, a third shelf disk 163, a fourth shelf disk 164, a fifth shelf disk 165, and a sixth shelf disk 166. The plurality of shelf collars 152 comprises a first shelf collar 171, a second shelf collar 172, a third shelf collar 173, a fourth shelf collar 174, a fifth shelf collar 175, and a sixth shelf collar 176. The plurality of pipes 121 comprises a first pipe 201, a second pipe 202, a third pipe 203, a fourth pipe 204, a fifth pipe 205, and a sixth pipe 206.

The ferrule 123 of the first pipe 201 is inserted into the center post 113 of the base 101. The ferrule 123 of the second pipe 202 is inserted into the second end 222 of the first pipe 201. The ferrule 123 of the third pipe 203 is inserted into the second end 222 of the second pipe 202. The ferrule 123 of the fourth pipe 204 is inserted into the second end 222 of the third pipe 203. The ferrule 123 of the fifth pipe 205 is inserted into the second end 222 of the fourth pipe 204. The ferrule 123 of the sixth pipe 206 is inserted into the second end 222 of the fifth pipe 205. The first shelf collar 171 secures the first pipe 201 to the center post 113. The first shelf disk 161 is placed on top of the first shelf collar 171. The second shelf collar 172 secures the second pipe 202 and the first pipe 201. The second shelf disk 162 is placed on top of the second shelf collar 172. The third shelf collar 173 secures the third pipe 203 and the second pipe 202. The third shelf disk 163 is placed on top of the third shelf collar 173. The fourth shelf collar 174 secures the fourth pipe 204 and the third pipe 203. The fourth shelf disk 164 is placed on top of the fourth shelf collar 174. The fifth shelf collar 175 secures the fifth pipe 205 and fourth pipe 204. The fifth shelf disk 165 is placed on top of the fifth shelf collar 175. The sixth shelf collar 176 secures the sixth pipe 206 and fifth pipe 205. The sixth shelf disk 166 is placed on top of the sixth shelf collar 176. The collar ferrule 135 of the lamp collar 132 is inserted into the second end 222 of the sixth pipe 206.

The holiday tree 108 configuration provides the decorative functions provided by an artificial tree during selected holiday seasons. The holiday tree 108 configuration is a skirt 180 and a plurality of bales 184 that are added to the display rack 107 configuration of the invention 100.

The purpose of plurality of bales 184 is to act as a filler material that provides the holiday tree 108 with a fuller look during use. Each of the plurality of bales 184 is a cylindrical structure. Each of the plurality of bales 184 is further formed with a slit in one direction from the center axis of the cylindrical structure of each bale to the face of the cylindrical structure of the bale. This slit allows the each bale to be wrapped around the stanchion 102. Each bale selected from the plurality of bales 184 rests on a shelf disk selected from the plurality of shelf disks 151.

Figure 7:
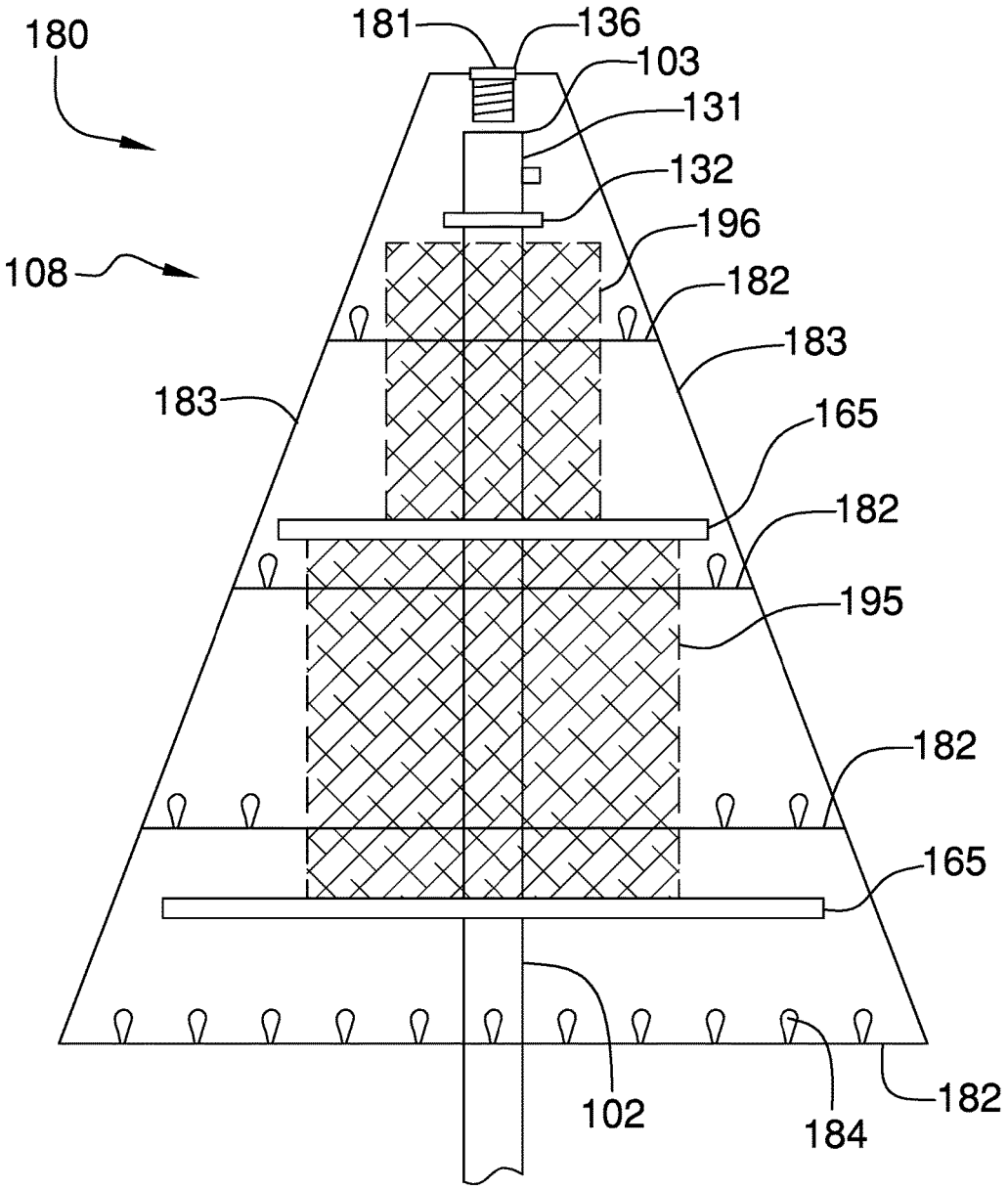
FIG. 7 is a detail view of an embodiment of the disclosure.
Figure 8:
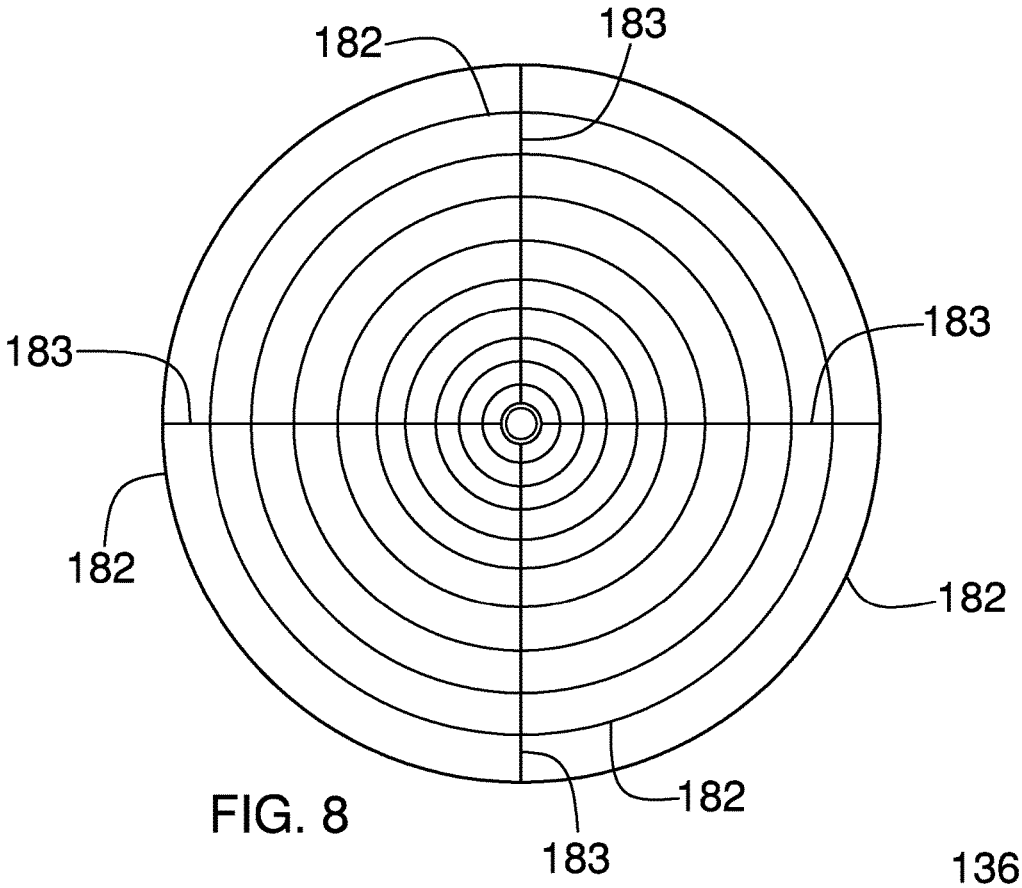
FIG. 8 is a detail view of an embodiment of the disclosure.

In the first potential embodiment of the disclosure, as shown most clearly in FIGS. 7 and 8, the skirt 180 further comprises a tree plug 181, a plurality of concentric wires 182, a plurality of support lines 183, and a plurality of lights 185. The plurality of lights 185 is attached to the plurality of concentric wires 182. The plurality of concentric wires 182 are interconnected by the plurality of support lines 183. The plurality of support lines 183 are connected to the tree plug 181 such that the plurality of concentric wires can be suspended from the socket 131. Each of the plurality of concentric wires 182 is a stiff ring made of wire. Each of the plurality of concentric wires 182 can be decorated in the manner of the branch of a coniferous tree. Each of the plurality of support lines 183 is a cord. The plurality of lights 185 comprises one or more sets of readily and commercially available holiday lights that are commonly known as string lights, festive lights, or Christmas lights.

As shown most clearly in FIG. 7, the skirt 180 is attached to the display rack 107 configuration of the invention 100 by screwing the tree plug 181 directly into the socket 131. Once the tree plug 181 is attached to the socket, the plurality of concentric wires 182 is draped around the display rack 107 configuration in order to change the appearance of the invention 100 to the look of a holiday tree.

In a second potential embodiment of the disclosure, the plurality of concentric rings 182 can be directly replaced with a metal volute. No other adjustments to the first potential embodiment of the disclosure would be required.

In all potential embodiments described in this disclosure, the tree plug 181 is wired to provide electric power to the plurality of lights 185. Methods to connect the tree plug 181 to the plurality of lights 185 are well known and documented in the electrical arts.

In the first and second potential embodiments of the disclosure, the plurality of bales 184 comprises a first bale 191, a second bale 192, a third bale 193, a fourth bale 194, a fifth bale 195, and a sixth bale 196. The first bale 191 is placed on the first shelf disk 161 such that the first bale 191 wraps around the stanchion 102. The second bale 192 is placed on the second shelf disk 162 such that the second bale 192 wraps around the stanchion 102. The third bale 193 is placed on the third shelf disk 163 such that the third bale 193 wraps around the stanchion 102. The fourth bale 194 is placed on the fourth shelf disk 164 such that the fourth bale 194 wraps around the stanchion 102. The fifth bale 195 is placed on the fifth shelf disk 165 such that the fifth bale 195 wraps around the stanchion 102. The sixth bale 196 is placed on the sixth shelf disk 166 such that the sixth bale 196 wraps around the stanchion 102.

The following definitions were used in this disclosure:

Apex: As used in this disclosure, an apex is the point of an object that has the greatest height or altitude relative to a given reference.

Cable: As used in this disclosure, a cable is a collection of insulated wires covered by a protective casing that is used for transmitting electricity or telecommunication signals.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cone: As used in this disclosure, a cone is a surface that is generated by rotating a triangle around one of the legs of the triangle. If a line that is perpendicular to the base that is drawn from the center of the base goes through the vertex of the triangle then the cone is called a right cone. A cone is a type of quadric surface.

Congruent: As used in this disclosure, congruent is a term that compares a first object to a second object. Specifically, two objects are said to be congruent when the perimeter, diameter, or shape of the first object can be superimposed over the perimeter, diameter, or shape of the second object such that the perimeter, diameter, or shape of the first object coincides, within manufacturing tolerances, with the perimeter, diameter, or shape of the second object Cord: As used in this disclosure, a cord is a long, thin, and flexible piece of string, line, or rope. Cords are made from yarns, piles, or strands of material that are braided or twisted together or from a monofilament (such as fishing line). Cords have tensile strength but are too flexible to provide compressive strength and are not suitable for use in pushing objects. String, line, and rope are synonyms for cord.

Correspond: As used in this disclosure, the term correspond is used as a comparison between two or more objects wherein one or more properties shared by the two or more objects match, agree, or align within acceptable manufacturing tolerances.

Conical Plate: As used in this disclosure, a conical plate is a structure that is formed from a plurality of plates. Each plate selected from the plurality of plates is differentiated from plates remaining in the plurality of plates by the span of the diameter of the plate of the selected plate compared to the span of the corresponding diameter of the remaining plates in the plurality of plates. The plurality of plates are stacked upon each other such that: 1) the centers of each of the plurality of plates are aligned such these centers form a line that is perpendicular to the supporting surface upon which the plurality of plates are stacked; 2) the plurality of plates are stacked in a decreasing order based of the span of the diameter of the plate; 3) the plurality of plates are stacked such that the plate with the maximum span of the diameter of the plate is proximal to the supporting surface; and, 4) the plurality of plates are stacked such that the plate with the minimum span of the diameter of the plate is distal from the supporting surface. A conical plate formed from a plurality of circular disks is commonly seen and often referred to as a Tower of Hanoi.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Diameter: As used in this disclosure, a diameter of an object is a straight line segment that passes through the center of an object. The line segment of the diameter is terminated at the perimeter or boundary of the object through which the line segment of the diameter runs.

Disk: As used in this disclosure, a disk is a cylindrically shaped object that is flat in appearance.

Exterior Screw Thread: An exterior screw thread is a ridge wrapped around the outer surface of a tube in the form of a helical structure that is used to convert rotational movement into linear movement.

Ferrule: As used in this disclosure, a ferrule is a cylindrical device that is used to interconnect pipes in a tent pole configuration.

Form Factor: As used in this disclosure, the term form factor refers to the size and shape of an object.

Inner Diameter: As used in this disclosure, the term inner diameter is used in the same way that a plumber would refer to the inner diameter of a pipe.

Interior Screw Thread: An interior screw thread is a groove that is formed around the inner surface of a tube in the form of a helical structure that is used to convert rotational movement into linear movement.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Light: As used in this disclosure, a light is an electrical device that generates visible light to illuminate objects so they can be seen.

National Electric Grid: As used in this disclosure, the national electric grid is a synchronized and highly interconnected electrical network that distributes energy in the form of electric power from a plurality of generating stations to consumers of electricity.

NEMA 1-15P Electrical Plug: As used in this disclosure, the NEMA 1-15P Electrical Plug is a plug that is designed to be inserted into a NEMA 5-15 Electrical Socket for the purpose of delivering electrical power to electrical devices. The NEMA 1-15P Electrical Plug is a 2 blade plug that is commonly found within residential and office environments within the United States.

Outer Diameter: As used in this disclosure, the term outer diameter is used in the same way that a plumber would refer to the outer diameter of a pipe.

Outlet: As used in this disclosure, an outlet is a device placed in the electrical wiring system of a building where electrical current can be taken to run electrical devices. In this disclosure an outlet is a socket adapted to receive a plug.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Plug: As used in this disclosure, a plug is an electrical termination that electrically connects a first electrical circuit to a second electrical circuit or a source of electricity. As used in this disclosure, a plug will have two or three metal pins.

Prism: As used in this disclosure, a prism is a 3 dimensional geometric structure wherein: 1) the form factor of two faces of the prism correspond to each other; and, 2) the two corresponding faces are parallel to each other. In this disclosure, when further description is required a prism will be named for the geometric or descriptive name of the form factor of the two corresponding faces. If the form factor of the two corresponding faces has no clearly established or well-known geometric or descriptive name, the term irregular prism will be used.

Radial hole: As used in this disclosure, a radial hole comprises a hole that is formed through a solid cylinder such that: 1) the formed hole is cylindrical; 2) the center axis of the formed hole is perpendicular to the center axis of the solid cylinder; and, 3) the center axis of the formed hole intersects the center axis of the solid cylinder. When the term radial hole is applied to a pipe, or other hollow cylindrical object, the term applies to two holes that are formed in the surface of the pipe in a manner that is consistent with the first definition. When the term radial hole is applied to a prism formed from an N-gon when N is an even number, the assumption should be made that the center axis is formed by a line that connects the center of the first corresponding face to the center of the second corresponding face.

Socket: As used in this disclosure, a socket is an electrical device that 1) forms an opening or a cavity that acts as a receptacle for an inserted object; and 2) is designed to receive or transfer electricity to or from the object inserted in the socket.

Stanchion: As used in this disclosure, a stanchion refers to an upright pole, post, or support.

Tent Pole Configuration: As used in this disclosure, a tent pole configuration is a method of interconnecting a plurality of pipes (or other hollow tubular objects). With the exception of the span of the length of the center axis of the pipe, each pipe contained in the plurality of pipes is otherwise identical to the pipes remaining in the plurality of pipes. In a tent pole configuration, each of the plurality of pipes is fitted with a ferrule. The ferrule is a cylindrical object that is attached to an end of each pipe such that the center axis of the ferrule is aligned with the center axis of the pipe. The outer diameter of the ferrule is less than the inner diameter of the pipe. To interconnect the plurality of pipes into a tent pole configuration, the ferrule of a first pipe selected from the plurality of pipes is inserted into the non-ferrule end of a second pipe selected from the plurality of pipes. This process is continued until all the pipes contained within the plurality of pipes are interconnected.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Volute: As used in this disclosure, a volute is the three dimensional structure that would be formed by a wire that is wound uniformly around the surface of a cone. A synonym for volute is a conical helix.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A convertible furniture combination comprising:

a base, a stanchion, and an electric fixture;

wherein the base attaches to the stanchion;

wherein the electric fixture attaches to the stanchion;

wherein the convertible furniture combination is a convertible item of furniture for domestic use;

wherein the function of the convertible furniture combination is a kit that includes a lamp configuration, an apparel rack configuration, a display rack configuration, and a holiday tree configuration;

wherein the stanchion comprises a plurality of pipes;

wherein each of the plurality of pipes further comprises a tube and a ferrule;

wherein each of the plurality of pipes is further defined with a first end and a second end;

wherein the ferrule is attached to the first end of the tube;

wherein the stanchion is formed by interconnecting each of the plurality of pipes in a tent pole configuration;

wherein the second end of each pipe selected in the plurality of pipes has formed in it a first radial hole;

wherein the ferrule of each pipe selected in the plurality of pipes has formed in it a second radial hole;

wherein the first radial hole and the second radial hole are located such that when the ferrule of a second pipe selected from the plurality of pipes is inserted into the second end of a first pipe selected from the plurality of pipes the first radial hole of the first selected pipe and the second radial hole of the second selected pipe will align;

wherein the stanchion further comprises a plurality of collar sets;

wherein the plurality of collar sets further comprises a collection of individual collar sets;

wherein each individual collar set contained within the plurality of collar sets is customized to support a function of the convertible furniture combination;

wherein any collar selected from any collar set contained within the plurality of collar sets further comprises a first arm and a second arm;

wherein the first arm is formed with a first hole that allows the first arm to be attached to the first radial hole;

wherein the second arm is formed with a second hole that allows the second arm to be attached to the second radial hole;

wherein the attachment of the first arm of the selected collar and the second arm of the selected collar to the stanchion attaches the selected collar to the stanchion;

wherein the base comprises a floor disk, a plurality of struts, and a center post;

wherein the floor disk is a disk shaped structure that rests on a supporting surface;

wherein the floor disk attaches to the center post using the plurality of struts;

wherein the center post is a cylindrical pipe;

wherein the center post is positioned relative to the floor disk such that the center axis of the center post passes through the center of the floor disk;

wherein the span of the inner diameter of the center post is the same of the span of the inner diameter of the second end of any pipe selected from the plurality of pipes such that the ferrule can be inserted into the center post;

wherein a third radial hole is formed in the end of the center post that is distal from the supporting surface.

2. The convertible furniture combination according to claim 1 wherein the electric fixture comprises a socket, a lamp collar, a cable, and a plug;

wherein the socket provides an electrical power connection using an interior screw thread of a threaded connection;

wherein the socket is attached to the lamp collar;

wherein the lamp collar attaches the socket to the end of the stanchion that is distal from the base;

wherein the lamp collar is further formed with a collar ferrule that is used to attach the lamp collar to the stanchion;

wherein the collar ferrule further comprises a fourth radial hole;

wherein the cable transports electricity from a national electric grid to the socket;

wherein the cable is threaded through the center post, the stanchion, and the lamp collar;

wherein the cable is terminated with a plug.

3. The convertible furniture combination according to claim 2 wherein the convertible furniture combination further comprises a plurality of conversion plugs;

wherein each of the plurality of conversion plugs is customized to support one of the functions of the convertible furniture combination;

wherein each conversion plug selected from the plurality of conversion plugs further comprises an exterior screw thread that allows the selected conversion plug to be screwed into the socket.

4. The convertible furniture combination according to claim 3 wherein the plurality of collar sets further comprises one or more hook collars;

wherein the apparel rack configuration further comprises the one or more collar hooks;

wherein each of one or more hook collars further comprises a first plurality of apparel hooks;

wherein each of the one or more hook collar attaches to the stanchion.

5. The convertible furniture combination according to claim 4 wherein the plurality of conversion plugs further comprises a hook plug;

wherein the apparel rack configuration further comprises the hook plug;

wherein the hook plug further comprises a second plurality of apparel hooks.

6. The convertible furniture combination according to claim 5 wherein the plurality of collar sets further comprises a plurality of shelf collars;

wherein the display rack configuration further comprises a plurality of shelf disks and the plurality of shelf collars;

wherein each of the plurality of shelf disks is mounted on a shelf collar selected from the plurality of shelf collars.

7. The convertible furniture combination according to claim 6 wherein each of the plurality of shelf disks is a plate that is formed in the shape of a circular disk;

wherein any shelf disk selected from the plurality of shelf disks is differentiated from every shelf disk remaining in the plurality of shelf disks the difference in the span of the diameter of each of the plurality of shelf disks;

wherein each shelf disk selected from the plurality of shelf disks further comprises a post hole;

wherein the post hole is a cylindrical aperture formed through the selected shelf disk such that the center axis of the post hole aligns with both the center and the center axis of the selected shelf disk;

wherein the span of the diameter of the post hole is greater than the span of the outer diameter of each of the plurality of pipes such that each of the plurality of pipes can be inserted through the post hole;

wherein the diameter of the post hole of each of the plurality of shelf disks is congruent.

8. The convertible furniture combination according to claim 7 wherein each of the plurality of shelf collars is a disk shaped collar;

wherein the diameter of each of the plurality of shelf collars is greater than the diameter of the post holes;

wherein each shelf disk selected from the plurality of shelf disks is supported by a shelf collar selected from the plurality of shelf collars.

9. The convertible furniture combination according to claim 8 wherein the plurality of shelf disks are attached to the stanchion such that the plurality of shelf disks form a conical plate structure that further comprises a space between each of the plurality of shelf disks.

10. The convertible furniture combination according to claim 9 wherein the plurality of shelf disks comprises a first shelf disk, a second shelf disk, a third shelf disk, a fourth shelf disk, a fifth shelf disk, and a sixth shelf disk;

wherein the plurality of shelf collars comprises a first shelf collar, a second shelf collar, a third shelf collar, a fourth shelf collar, a fifth shelf collar, and a sixth shelf collar;

wherein the plurality of pipes comprises a first pipe, a second pipe, a third pipe, a fourth pipe, a fifth pipe, and a sixth pipe;

wherein the ferrule of the first pipe is inserted into the center post of the base;

wherein the ferrule of the second pipe is inserted into the second end of the first pipe;

wherein the ferrule of the third pipe is inserted into the second end of the second pipe;

wherein the ferrule of the fourth pipe is inserted into the second end of the third pipe;

wherein the ferrule of the fifth pipe is inserted into the second end of the fourth pipe;

wherein the ferrule of the sixth pipe is inserted into the second end of the fifth pipe;

wherein the first shelf collar secures the first pipe to the center post;

wherein the first shelf disk is placed on top of the first shelf collar;

wherein the second shelf collar secures the second pipe and the first pipe;

wherein the second shelf disk is placed on top of the second shelf collar;

wherein the third shelf collar secures the third pipe and the second pipe;

wherein the third shelf disk is placed on top of the third shelf collar;

wherein the fourth shelf collar secures the fourth pipe and the third pipe;

wherein the fourth shelf disk is placed on top of the fourth shelf collar;

wherein the fifth shelf collar secures the fifth pipe and fourth pipe;

wherein the fifth shelf disk is placed on top of the fifth shelf collar;

wherein the sixth shelf collar secures the sixth pipe and fifth pipe;

wherein the sixth shelf disk is placed on top of the sixth shelf collar;

wherein the collar ferrule of the lamp collar is inserted into the second end of the sixth pipe.

11. The convertible furniture combination according to claim 9 wherein the holiday tree configuration comprises a skirt and a plurality of bales;

wherein each bale selected from the plurality of bales rests on a shelf disk selected from the plurality of shelf disks;

wherein the skirt is attached to the socket;

wherein each of the plurality of bales is a cylindrical structure;

wherein each of the plurality of bales is further formed with a slit in one direction from the center axis of the cylindrical structure of each bale to a face of the cylindrical structure of the bale;

wherein each bale wraps around the stanchion.

12. The convertible furniture combination according to claim 11 wherein the plurality of conversion plugs further comprises a tree plug;

wherein the skirt further comprises a tree plug, a plurality of concentric wires, a plurality of support lines, and a plurality of lights;

wherein the plurality of lights is attached to the plurality of concentric wires;

wherein the plurality of concentric wires are interconnected by the plurality of support lines;

wherein the plurality of support lines are connected to the tree plug wherein each of the plurality of concentric wires is a ring;

wherein each of the plurality of support lines is a cord.

13. The convertible furniture combination according to claim 12 wherein the skirt is attached to the display rack configuration of the convertible furniture combination by screwing the tree plug directly into the socket such that the plurality of concentric wires is suspended from and surrounds the display rack configuration;

wherein the tree plug is wired to provide electric power to the plurality of lights;

wherein the plurality of collar sets further comprises one or more hook collars;

wherein the apparel rack configuration further comprises the one or more collar hooks;

wherein each of one or more hook collars further comprises a first plurality of apparel hooks;

wherein each of the one or more hook collar attaches to the stanchion;

wherein the plurality of conversion plugs further comprises a hook plug;

wherein the apparel rack configuration further comprises the hook plug;

wherein the hook plug further comprises a second plurality of apparel hooks.

14. The convertible furniture combination according to claim 10 wherein the holiday tree configuration comprises a skirt and a plurality of bales;

wherein each bale selected from the plurality of bales rests on a shelf disk selected from the plurality of shelf disks;

wherein the skirt is attached to the socket;

wherein each of the plurality of bales is a cylindrical structure;

wherein each of the plurality of bales is further formed with a slit in one direction from the center axis of the cylindrical structure of each bale to a face of the cylindrical structure of the bale;

wherein each bale wraps around the stanchion;

wherein the plurality of conversion plugs further comprises a tree plug;

wherein the skirt further comprises a tree plug, a plurality of concentric wires, a plurality of support lines, and a plurality of lights;

wherein the plurality of lights is attached to the plurality of concentric wires;

wherein the plurality of concentric wires are interconnected by the plurality of support lines;

wherein the plurality of support lines are connected to the tree plug wherein each of the plurality of concentric wires is a ring;

wherein each of the plurality of support lines is a cord;

wherein the skirt is attached to the display rack configuration of the convertible furniture combination by screwing the tree plug directly into the socket such that the plurality of concentric wires is suspended from and surrounds the display rack configuration;

wherein the tree plug is wired to provide electric power to the plurality of lights;

wherein the plurality of bales comprises a first bale, a second bale, a third bale, a fourth bale, a fifth bale, and a sixth bale;

wherein the first bale is placed on the first shelf disk such that the first bale wraps around the stanchion;

wherein the second bale is placed on the second shelf disk such that the second bale wraps around the stanchion;

wherein the third bale is placed on the third shelf disk such that the third bale wraps around the stanchion;

wherein the fourth bale is placed on the fourth shelf disk such that the fourth bale wraps around the stanchion;

wherein the fifth bale is placed on the fifth shelf disk such that the fifth bale wraps around the stanchion;

wherein the sixth bale is placed on the sixth shelf disk such that the sixth bale wraps around the stanchion;

wherein the plurality of collar sets further comprises one or more hook collars;

wherein the apparel rack configuration further comprises the one or more collar hooks;

wherein each of one or more hook collars further comprises a first plurality of apparel hooks;

wherein each of the one or more hook collar attaches to the stanchion;

wherein the plurality of conversion plugs further comprises a hook plug;

wherein the apparel rack configuration further comprises the hook plug;

wherein the hook plug further comprises a second plurality of apparel hooks.

* * * * *